US008632659B2

(12) United States Patent
Ehrhardt et al.

(10) Patent No.: US 8,632,659 B2
(45) Date of Patent: Jan. 21, 2014

(54) PAPER SIZING COMPOSITION

(75) Inventors: Susan M. Ehrhardt, Haddonfield, NJ (US); Kyle J. Bottorff, Newark, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 12/971,172

(22) Filed: Dec. 17, 2010

(65) Prior Publication Data

US 2011/0146926 A1 Jun. 23, 2011

Related U.S. Application Data

(60) Provisional application No. 61/287,822, filed on Dec. 18, 2009.

(51) Int. Cl.
*D21H 11/00* (2006.01)

(52) U.S. Cl.
USPC ..... 162/164.6

(58) Field of Classification Search
USPC ..... 162/164.6, 158; 524/356, 47; 106/218
See application file for complete search history.

(56) References Cited

U.S. PATENT DOCUMENTS

| | | | | |
|---|---|---|---|---|
| 2,785,067 | A | 3/1957 | Osberg, Jr. | |
| 2,961,366 | A | 11/1960 | Weisgerber | |
| 3,223,544 | A | 12/1965 | Savina | |
| 4,861,376 | A | 8/1989 | Edwards et al. | |
| 4,964,915 | A | 10/1990 | Blixt et al. | |
| 5,846,308 | A * | 12/1998 | Lauzon | 106/218 |
| 6,159,340 | A | 12/2000 | Niessner | |
| 6,315,824 | B1 | 11/2001 | Lauzon | |
| 2000/6037512 | | 2/2006 | Pawlowska et al. | |
| 2006/0162883 | A1 | 7/2006 | Champ et al. | |
| 2007/0133729 | A1 | 6/2007 | Hsiao et al. | |
| 2007/0167558 | A1 | 7/2007 | Bonn et al. | |
| 2007/0261807 | A1 | 11/2007 | Taggart et al. | |
| 2008/0041546 | A1 | 2/2008 | Schmid et al. | |

FOREIGN PATENT DOCUMENTS

| | | |
|---|---|---|
| DE | 102 37 911 | 2/2004 |
| WO | WO2005083174 | 9/2005 |

* cited by examiner

*Primary Examiner* — Mark Halpern
(74) *Attorney, Agent, or Firm* — Michael J. Herman; Joanne Rossi; Shaorong Chen

(57) ABSTRACT

A stable paper sizing composition comprising a dispersion of ketene dimer and a pH adjusted vinylamine containing polymer is disclosed. The method of preparing the stable sizing composition and the method of using the stable sizing composition is also disclosed.

4 Claims, No Drawings

PAPER SIZING COMPOSITION

This Application claims priority of U.S. Provisional Application No. 61/287,822, filed Dec. 18, 2009, the entire contents of which are herein incorporated by reference.

FIELD OF THE INVENTION

This invention is related to improvements in the sizing of paper with aqueous ketene dimer dispersions and the stability of the ketene dimer dispersions containing vinylamine-containing polymers.

BACKGROUND OF THE INVENTION

Weisgerber (U.S. Pat. No. 2,961,366) teaches the use of polyvinylamine to improve the retention of ketene dimer by paper fibers, the increased retention resulting in a greater degree of sizing. In his teachings, Weisgerber indicated that the polyvinylamine could be added separately from the sizing agent to the pulp slurry, but the preferred mode of addition was to the aqueous emulsion of ketene dimer just prior to adding the ketene dimer to the papermaking system.

As Weisgerber taught the addition of polyvinylamine to the aqueous emulsion of ketene dimer just prior to adding the emulsion to the papermaking system, he was not concerned with the long term stability of the blend. However, for aqueous emulsions of alkyl ketene dimer to be commercially viable they must be stable for extended periods of time. Aqueous emulsions of ketene dimer must be both physically and chemically stable. Physical stability refers to sufficiently stable viscosity that the emulsions remain pumpable and dilatable until added to the papermaking system. Chemical stability refers to maintaining the assay of the ketene dimer in the emulsion at a high level until added to the papermaking system.

Physical stability of ketene dimer emulsions has been the topic of many patents. For example, Edwards, et at (U.S. Pat. No. 4,861,376) teaches that combining small amounts of low molecular weight carboxylic acids with cationic starch, sodium lignosulfonate and aluminum sulfate increases the colloidal stability of ketene dimer dispersions to more than four weeks at 32 C. Schmid, et al. (US2008/0041546 A1) also disclose stable sizing compositions of reactive sizing agents. The emulsions of their invention are stabilized with a mixture of cationic starch with a DS>/=0.05, anionic dispersant and a linear nitrogen-containing polymer. Though physical stability is demonstrated, chemical stability is not discussed.

Stable starch-stabilized dispersions of ketene dimer are well known in the industry, see, for example, U.S. Pat. No. 4,861,376 to Edwards, et at or U.S. Pat. No. 4,964,915 to Blixt, et al. Simple blends of these starch-stabilized dispersions of ketene dimer with commercial polyvinylamine result in physically unstable products that gel within minutes. Blends of starch-stabilized dispersions of ketene dimer and polyvinylamine, that has been pH adjusted as disclosed in US2008/0041546 A1, are also physically unstable, solidifying on storage (see Example 5 of US2008/0041546 A1).

SUMMARY OF INVENTION

It has been found that dispersions of ketene dimer containing vinylamine containing polymers, such as polyvinylamine, that are both physically and chemically stable by simple post-addition of the vinylamine containing polymer to a dispersion of ketene dimer with proper pH adjustment of the vinylamine containing polymer can be made. Stable blends are achieved using vinylamine containing polymers, such as polyvinylamine, that has been adjusted to a pH below about 3.3. It has also been discovered that aging these sizing compositions for a period of time before addition to the papermaking system can improve sizing efficiency.

A paper sizing composition is disclosed. The composition comprises a dispersion of ketene dimer and a pH adjusted vinylamine containing polymer that are stable and provide enhanced sizing efficiency wherein the pH of the pH adjusted vinylamine-containing polymer is below 3.3.

A method of preparing the stable sizing composition is disclosed. The method comprises 1) adjusting the pH of a vinylamine-containing polymer below about 3.3, and 2) blending the pH adjusted vinylamine-containing polymer with a dispersion of ketene dimer.

A method of sizing paper is disclosed. The method comprises 1) adjusting the pH of a vinylamine-containing polymer below about 3.3, 2) blending the pH adjusted vinylamine-containing polymer with a dispersion of ketene dimer, 3) holding the blend of the vinylamine containing polymer and the dispersion of ketene dimer for a least one hour and 4) applying the blend of the vinylamine containing polymer and dispersion of ketene dimer to the pulp slurry in a papermaking process or applied at the size press.

In a preferred embodiment of the invention, the ketene dimer dispersion is a starch stabilized ketene dimer dispersion.

DETAILED DESCRIPTION OF INVENTION

This invention provides paper sizing compositions comprising dispersions of ketene dimer and vinylamine-containing polymer, such as polyvinylamine, that are stable and provide enhanced sizing efficiency. The stable paper sizing compositions contain a vinylamine-containing polymer, a dispersant system and alkyl ketene dimer. These sizing compositions are prepared by 1) adjusting the pH of the polymer below about 3.3 prior to blending with the dispersion of ketene dimer and then 2) blending the polymer with a dispersion of ketene dimer, and 3) optionally aging this blend before introduction to the papermaking system for optimal sizing performance. Preferably the dispersion of ketene dimer is starch stabilized.

The sizing compositions of the present invention are both physically and chemically stable. For the purposes of this patent, a dispersion is said to be physically stable if viscosity does not exceed about 400 cps over 4 weeks storage at 32° C. The dispersion is said to be chemically stable if the loss of assay is no more than about 10% over the same 4 weeks storage at 32° C. Assay refers to the amount of ketene dimer present in the initial emulsion formulation. The ketene dimer can react with water over time to form what is commonly referred to as the diketone, which results in a loss of assay. The diketone is not an effective sizing agent, so it is desirable to keep this loss to a minimum.

Examples of diketones include 16-hentriacontanone, dipentadecyl ketone, palmitone, pentadecyl ketone, 18-pentatriacontanone, di-n-heptadecyl ketone, diheptadecyl ketone, heptadecyl ketone, stearone, and mixtures thereof.

Any of the ketene dimers known in the art may be used in the process of the present invention. Ketene dimers used as sizing agents are dimers having the formula:

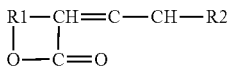

wherein R1 and R2 are alkyl radicals, which may be saturated or unsaturated, having from 6 to 24 carbon atoms, preferably more than 10 carbon atoms and most preferably from 14 to 16 carbon atoms. R1 and R2 can be the same or different. These ketene dimers are well known, for example from U.S. Pat. No. 2,785,067, the disclosure of which is incorporated herein by reference.

Suitable ketene dimers include decyl, dodecyl, tetradecyl, hexadecyl, octadecyl, eicosyl, docosyl, tetracosyl ketene dimers, as well as ketene dimers prepared from palmitoleic acid, oleic acid, ricinoleic acid, linoleic acid, myristoleic acid, isostearic and eleostearic acid. The ketene dimer may be a single species or may contain a mixture of species. The most preferred ketene dimers are alkyl ketene dimers prepared from C12-C22 linear saturated natural fatty acids, oleic acid, isostearic acid, or mixtures thereof.

Suitable ketene dimers used as sizing agents are also known as: 4-heptadecylidene-3-hexadecyl-2-Oxetanone; 2-hexadecyl-3-hydroxy-3-Eicosenoic acid, β-lactone (6CI); Cetylketene dimer; Hexadecylketene dimer; Palmitylketene dimer; 4-heptadecylidene-3-tetradecyl-2-Oxetanone; 3-hexadecyl-4-pentadecylidene-2-Oxetanone; 4-pentadecylidene-3-tetradecyl-2-Oxetanone; Myristylketene dimer; Tetradecylketene dimer; 4-(15-methylhexadecylidene)-3-(14-methylpentadecyl)-2-Oxetanone; Isostearyl ketene dimer; 4-(8Z)-8-heptadecen-1-ylidene-3-(7Z)-7-hexadecen-1-yl-2-Oxetanone; 4-(8-heptadecenylidene)-3-(7-hexadecenyl)-2-Oxetanone; 4-(8Z)-8-heptadecenylidene-3-(7Z)-7-hexadecenyl-2-Oxetanone (9CI); Oleic ketene dimer; and mixtures thereof.

Starch-stabilized dispersions of ketene dimers are well known in the art. Such dispersions comprise a cationic starch, an anionic dispersant and may contain some level of aluminum sulfate or a polyaluminum salt. The cationic starch is any water-soluble starch carrying sufficient cationic amino groups to render the starch positively charged in solution. The degree of substitution is preferably less than 0.05 and more preferably less than 0.048 and greater than 0.042. The preferred starches are cationic waxy maize starches with quaternary amino groups as the source of the charge, such as StaLok 169 (sold by Tate & Lyle). Suitable anionic dispersants include lignosulfonatcs, poly-naphthalene sulfonates and styrene sulfonate-containing polymers. Sodium lignosulfonate is preferred. Examples of such dispersions can be found in U.S. Pat. No. 4,964,915 to Blixt, et al., U.S. Pat. No. 4,861,376 to Edwards, et al., and U.S. Pat. No. 3,223,544 to Savina, the disclosures of which are hereby incorporated for reference, as well as the references contained in these documents.

The pH of the starch stabilized ketene dimer emulsion used in the present invention is preferably below 5.0, more preferably below 4.5 and most preferably 4.3 or below.

Technically, the term emulsion refers to a two phase system with liquid droplets in a continuous liquid medium, and the term dispersion refers to a two phase system with solid particles in a continuous liquid medium. The physical state of the alkyl ketene dimer is dependent on the temperature of the system and the fatty acids used to prepare the ketene dimer; the alkyl ketene dimer in commercial sizing agents can be liquid or solid. As a result, the two terms are used interchangeably when referring to commercial sizing agents in the industry and this patent.

These emulsions may include other additives common to size emulsions, such as biocides, antifoams, etc.

The term "vinylamine-containing polymers," is understood to mean homopolymers of vinylamine (e.g., polyvinylamine or fully hydrolyzed polyvinylformamide), copolymers of vinylamine with other comonomers, partially hydrolyzed polyvinylformamide, partially hydrolyzed vinylformamide copolymers, vinylamine terpolymers, vinylamine homo- and copolymers manufactured by the Hofmann modification of acrylamide polymers. Examples of such polymers can be found in U.S. Pat. No. 6,159,340 to Niessner, et al.

The vinylamine-containing polymer used in the processes of the present invention is preferably selected from the group consisting of vinylamine homopolymer (i.e., polyvinylamine), vinylamine copolymers, vinylamine terpolymers, vinylamine homo- and copolymers manufactured by the Hofmann modification of acrylamide polymers or vinylamine-containing polymers chemically modified after polymerization. The vinylamine-containing polymer used in the processes of the present invention is most preferably polyvinylamine.

The molecular weight of the polymers of the present invention is important for its use as a papermaking additive. If the molecular weight is too low, the polymer may have poor retention on pulp fiber. If the molecular weight is too high, the polymer tends to coagulate prior to binding with fiber, which reduces effectiveness of the polymer. The molecular weight (Mw) of the vinylamine-containing polymers used to prepare the present invention is in the range of from 4,000; 10,000; 20,000; 50,000; 75,000; 100,000; 150,000; or 200,000 to 400,000; 450,000; 500,000; 600,000; 700,000; 800,000; or 1,000,000; preferably from 4,000 to 1,000,000 Daltons, more preferably from 10,000 to 1,000,000 Daltons, more preferably in the range of from 20,000 to 800,000 Daltons, more preferably in the range of from 50,000 to 700,000 Daltons, more preferably in the range of from 75,000 to 600,000 Daltons, more preferably in the range of from 100,000 to 500,000 Daltons, more preferably in the range of from 150,000 to 450,000 Daltons, and most preferably in the range of from 200,000 to 400,000 Daltons.

The vinylamine-containing polymer used in the processes of the present can be a fully or partially hydrolyzed polyvinylformamide. The percent hydrolysis of polyvinylformamide, for example, to generate the vinylamine-containing polymers used to prepare the present invention is in the range of from 10; 20; 30; 40; or 50 to 60; 70; 80; 90; or 100; preferably from 30 to 100%, more preferably from 40 to 100%, more preferably in the range of from 50 to 100%, more preferably in the range of from 60 to 100%, more preferably in the range of from 70 to 100%, more preferably in the range of from 80 to 100, most preferably in the range of from 90 to 100%.

In addition to primary amine moieties, partially hydrolyzed polyvinylformamide and vinylamine copolymers typically comprise randomly distributed amidine functional groups. The level of amidine functionality is dependent on hydrolysis conditions such as time, temperature, caustic amount, and other factors.

To prepare the sizing compositions of this invention the pH of the vinylamine-containing polymer, such as polyvinylamine, must first be adjusted to a stable pH below about 3.3. A pH below 3.0 is preferred, more preferably below 2.5 and a pH between 2.1 and 2.5 is most preferred. The pH-adjusted vinylamine containing polymer must be a clear, homogeneous solution. The pH adjustment can be made using mineral or organic acids. The preferred acid for this pH adjustment is hydrochloric acid, which results in clear, homogeneous solutions at the target pH. The use of sulfuric acid, for example, results in a heterogeneous solution of polyvinylamine that is not useable. Organic acids (e.g., formic acid) can also be used. Other commercially available acids include methylsulfonic acid, hydrobromic acid, phosphoric acid and nitric acid.

The pH-adjusted polymer is added to the dispersion of alkyl ketene dimer with good agitation at a level that achieves the desired sizing performance. Levels from 0.5% to 100% polymer, based on alkyl ketene dimer, can be used. Levels from 5% to 50% polymer, based on alkyl ketene dimer, are preferred. Higher levels of polymer provide higher levels of size development. The final emulsion pH should be less than about pH 3.

The sizing compositions of this invention can be used immediately, but it has been discovered that for optimal sizing performance the blends can be held or aged for several hours prior to using. Aging the sizing compositions significantly increases the amount of sizing developed with a given amount of alkyl ketene dimer and polymer, significantly boosting sizing efficiency. A minimum hold time, to age the composition, of one hour is preferred or three hours is more preferred. Preferably the hold time is from about 3 hours to about 8 hours. The composition can be held for greater than 8 hours. Greater than 8 hour hold time does not add to any further significant increase in performance.

The sizing agents prepared by this invention may be used in internal sizing in which the sizing dispersions are added to the pulp slurry in the wet end of the paper making process, or surface sizing in which the sizing dispersions are applied at the size press or the coater. This invention may also be used in one or both parts of a two-part sizing system. For example, one part may be mixed internally with the wood pulp and a second part applied at the size press, a common practice in papermaking.

The amount of sizing agent either added to the stock or applied as a surface size is from about 0.005 to 5% by weight of reactive sizing agent, based on the dry content of the stock, i.e., fibers and optional filler, and preferably from 0.01 to 1% by weight. The dosage is mainly dependent on the quality of the pulp or paper to be sized, the sizing compound used and the level of sizing desired.

Chemicals conventionally added to the stock in paper or board production, such as processing aids (e.g., retention aids, drainage aids, contaminant control additives, etc.) or other functional additives (e.g., wet or dry strength additives, dyes, optical brightening agents, etc.) can be used in combination with the sizing agents of this invention.

EXAMPLES

The following examples are given for the purpose of illustrating the present invention. All parts and percentages are by weight unless otherwise indicated.

In the following examples, sizing evaluations were made using a pilot scale paper machine designed to simulate a commercial Fourdrinier, including stock preparation, refining and storage. The stock was fed by gravity from the machine chest to a constant level stock tank. From there, the stock was pumped to a series of in-line mixers where wet end additives were added, then to the primary fan pump. The stock was diluted with white water at the fan pump to about 0.2% solids. Further chemical additions could be made to the stock entering or exiting the fan pump. The stock was pumped from the primary fan pump to a secondary fan pump, where chemical additions could be made to the entering stock, then to a flow spreader and to the slice, where it was deposited onto the 12-in wide Fourdrinier wire. Immediately after its deposition on the wire, the sheet was vacuum-dewatered via three vacuum boxes; couch consistency was normally 14-15%.

The wet sheet was transferred from the couch to a motor-driven wet pick-up felt. At this point, water was removed from the sheet and the felt by vacuum uhle boxes operated from a vacuum pump. The sheet was further dewatered in a single-felted press and left the press section at 38-40% solids.

Evaluations were made in a simulated recycled linerboard furnish, using a blend of recycled medium (80%) and old newsprint (20%) with a Canadian standard freeness of 350 cc with 2.75% sodium lignosulfonate added to simulate anionic trash. The hardness and alkalinity were 126 ppm and 200 ppm, respectively. Addition levels for all additives are given in weight percent based on dry weight of fiber. 0.3% cationic dent corn starch (Sta-Lok 300, Tate & Lyle) was added to the thick stock before the addition of the sizing agent. No other wet end additives were used. Stock temperature was maintained at 55 C. The headbox pH was controlled to 7.5 with caustic.

A 171 g/sq m (105 lb/3000 ft2 ream) sheet was formed and dried on seven dryer cans to 7% moisture (dryer can surface temperatures at 90 C) and passed through a single nip of a 5-nip, 6 roll calendar stack. HST and Cobb sizing were measured on board naturally aged in a CT room (50% RH, 25 C) for a minimum of 7 days.

AKD emulsion: Hereon® 100 Sizing Agent, a cationic starch stabilized emulsion of alkyl ketene dimer (Hercules Incorporated, Wilmington Del.). The pH specification for this product is 2.1-4.2.

Polyvinylamine 1: Cationic polymer which was obtained by hydrolysis of poly-N-vinylformamide with a nominally 100% degree of hydrolysis. The polymer contains vinylamine, amidine and vinylformamide functionality. Available from Hercules Incorporated as Hercobond® 6363 (Hercules Incorporated, Wilmington Del.).

Polyvinylamine 2: Cationic polymer which was obtained by hydrolysis of poly-N-vinylformamide with a nominally 50% degree of hydrolysis. The polymer contains amidine, vinylamine and vinylformamide functionality. Available from Hercules Incorporated as Hercobond®6350 (Hercules Incorporated, Wilmington Del.).

Example 1

Adjustment of the Polymer pH to Low pH Provides Stable Blends pH adjustment of polyvinylamine resin:

35% HCl was slowly added to Polyvinylamine 1 with good agitation. The pH was monitored as the HCl was added. The amount of HCl was adjusted as needed to achieve the desired pH target. The pH was rechecked after several hours to make sure the pH was stable. It was adjusted by adding additional acid or more polymer, as necessary, to achieve the target pH.

Preparation of Blend:

The pH-adjusted polyvinylamine was slowly added to the starch-stabilized AKD emulsion, while stirring. An amount of pH-adjusted polyvinylamine sufficient to provide 12.5% polymer based on alkyl ketene dimer was added.

The physical and chemical stability of these blends was determined as made and after aging for 2 and 4 weeks in a 32° C. oven. Viscosity was used as a measure of physical stability. Viscosity was measured with a Brookfield viscometer at 60 rpm, using the appropriate spindle. Chemical stability was determined using an IR method to determine the level of active ketene dimer in the emulsions.

TABLE 1

Impact of polymer pH on the physical and chemical stability of the sizing composition, using hydrochloric acid for pH adjustment.

| | Physical Stability | | | Chemical Stability | | | |
|---|---|---|---|---|---|---|---|
| | Brookfield viscosity, 60 rpm | | | Dimer Assay | | | |
| Adjusted PVAm pH | as made (cps) | 2 weeks at 32 C. (cps) | 4 weeks at 32 C. (cps) | as made wt % | 2 weeks at 32 C. wt % | 4 weeks at 32 C. wt % | Assay Loss, % |
| 2.1 | 96 | 130 | 118 | 10.4 | 10 | 9.6 | 8% |
| 2.5 | 76 | 108 | 96 | 10.2 | 9.6 | 9.4 | 8% |
| 2.9 | 124 | 169 | 176 | 10.4 | 10.0 | 9.5 | 9% |
| 3.3 | 260 | 448 | 388 | 10.6 | 9.8 | 9.4 | 11% |
| 3.7 | 375 | 522 | 582; some gel | 10.7 | 9.80 | 9.6 | 10% |
| 5.0 | 312 | gelled | gelled | 10.9 | 8.80 | — | 19% |
| Unadjusted | gelled | — | — | — | — | — | — |

Clearly, at pH 3.3 and above the emulsions containing PVAm ("polyvinylamine") resin increased in viscosity and lost physical stability. At pH 5, chemical stability was poor. It is preferred that the PVam is adjusted to below 3.0 prior to combining with the ketene dimer.

Example 2

Organic Acids can Also be Used for pH Adjustment

The pH adjustment of the resin and preparation of the blends was the same as for Example 1, substituting formic acid for hydrochloric acid.

TABLE 2

Impact of polymer pH on the physical and chemical stability of the sizing composition, using formic acid for pH adjustment.

| | Physical Stability | | | Chemical Stability | | | |
|---|---|---|---|---|---|---|---|
| | Brookfield viscosity, 60 rpm | | | Dimer Assay | | | |
| PVAm pH after adjustment | as made (cps) | 2 weeks at 32 C. (cps) | 4 weeks at 32 C. (cps) | as made wt % | 2 weeks at 32 C. wt % | 4 weeks at 32 C. wt % | Assay Loss, % |
| 3.8 | 148 | 347 | semi gelled | 10.1 | 9.5 | 9.0 | 11% |
| 2.1 | 76 | 84 | 85 | 10.6 | 9.8 | 9.6 | 9% |

As with hydrochloric acid, pH adjustment to a low pH provided physical stability.

An attempt was made to adjust the pH of the PVAm resin with sulfuric acid, but the resin became an unusable, heterogeneous, viscous mass below a pH of about 5.

Example 3

Sizing Performance for the Sizing Composition of this Invention is Far Superior to Blends Made by Mixing the Resin with the Sizing Agent at the Addition Point A sizing composition prepared as described in Example 1 using Polyvinylamine 1 adjusted to pH 2.1. This sizing composition was evaluated on a pilot papermachine as described above after aging for 1 hour, 5 hours and 24 hours. It was compared to Hereon 100 sizing agent without polymer, and with polymer added at the addition point (T'd at addn pt) at the same ratio to alkyl ketene dimer used in the sizing compositions (12.5% based on dimer). Sizing was measured using the Hercules Sizing Test (Tappi method T 530) and the Cobb test (Tappi method T 441). In the Hercules Sizing Test higher numbers (longer penetration times) indicate improved sizing performance. In the Cobb test lower numbers (less water absorption) indicate improved sizing performance. The results are presented in Table 3.

TABLE 3

Aging the sizing compositions of this invention significantly boosts sizing efficiency.

| | | HST | | COBB TEST | |
|---|---|---|---|---|---|
| | Dimer Addn, % | 5 Reps seconds Mean | 20% FA INK 80% REFL. Std Dev | 2 Reps g/sq m Mean | WATER 2 MIN SOAK Std Dev |
| No PVAm | 0.100 | 3 | | 321 | 3.54 |
| No PVAm | 0.200 | 12 | | 161 | 7.07 |
| No PVAm | 0.300 | 39 | 1.48 | 66 | 2.83 |
| PVAm T'd at addn pt | 0.050 | 2 | | 332 | 3.54 |
| PVAm T'd at addn pt | 0.150 | 22 | 1.41 | 74 | 1.41 |
| PVAm T'd at addn pt | 0.250 | 165 | 8.00 | 35 | 0.71 |
| Example 1: aged 1 hr | 0.050 | 4 | | 288 | 4.95 |

TABLE 3-continued

Aging the sizing compositions of this invention significantly boosts sizing efficiency.

| | Dimer Addn, % | HST 5 Reps seconds Mean | 20% FA INK 80% REFL. Std Dev | COBB TEST 2 Reps g/sq m Mean | WATER 2 MIN SOAK Std Dev |
|---|---|---|---|---|---|
| Example 1: aged 1 hr | 0.150 | 60 | 2.77 | 34 | 0.00 |
| Example 1: aged 1 hr | 0.250 | 276 | 14.30 | 31 | 0.00 |
| Example 1: aged 5 hrs | 0.050 | 5 | | 269 | 9.90 |
| Example 1: aged 5 hrs | 0.150 | 83 | 0.58 | 35 | 2.12 |
| Example 1: aged 5 hrs | 0.250 | 379 | 19.60 | 30 | 0.00 |
| Example 1: aged 24 hrs | 0.050 | 5 | | 273 | 3.54 |
| Example 1: aged 24 hrs | 0.150 | 84 | 2.30 | 33 | 0.00 |
| Example 1: aged 24 hrs | 0.250 | 383 | 13.15 | 30 | 0.71 |

This example demonstrates the enhanced sizing performance of the sizing compositions of this invention. As taught by Weisgerber, the addition of PVAm to an emulsion of AKD improves sizing performance; compare 'No PVAm' to 'PVAm T'd at addn pt'. However, with the aged sizing compositions of this invention, it is possible to develop an even greater level of sizing with the same amounts of alkyl ketene dimer and polymer; compare 'PVAm T'd at addn pt' to any of the 'Example 1' data sets.

Example 4

A sizing composition was prepared using Polyvinylamine 2, as described in Example 1, adjusting the pH of the polyvinylamine to 2.1. This product, referred to as Example 4, was compared to Example 1 on the pilot paper machine as described above, after the sizing composition had aged for several days. The results are summarized in Table 4.

TABLE 4

Polyvinylamine with a lower level of hydrolysis can also be used in the sizing compositions of this invention.

| | Dimer Addn, % | HST 5 Reps 20% FA Ink/80% Refl seconds Mean | Std Dev | COBB TEST 2 Reps 2 min/WATER g/sq m Mean | Std Dev |
|---|---|---|---|---|---|
| No PVAm | 0.1 | 5 | 0.00 | 257.0 | 5.66 |
| No PVAm | 0.2 | 15 | 0.84 | 129.5 | 0.71 |
| No PVAm | 0.3 | 49 | 3.29 | 61.5 | 2.12 |
| Example 4 | 0.05 | 5 | 0.00 | 198.0 | 8.49 |
| Example 4 | 0.15 | 74 | 4.51 | 37.0 | 2.83 |
| Example 4 | 0.25 | 345 | 11.90 | 29.0 | 1.41 |
| Example 1 | 0.05 | 6 | 0.00 | 137.5 | 2.12 |
| Example 1 | 0.15 | 118 | 6.89 | 30.0 | 0.00 |
| Example 1 | 0.25 | 390 | 34.15 | 26.5 | 0.71 |

Both polyvinylamines resulted in a substantial improvement in sizing, as reflected in both the higher HST sizing numbers and lower Cobb numbers.

Example 5

Varying Ratios of Ketene Dimer to Polyvinylamine

Sizing compositions were prepared as in Example 1 varying the ratio of polyvinylamine ratio to dimer. In all cases Polyvinylamine 1 adjusted to pH 2.1 with hydrochloric acid was used. These sizing compositions were evaluated on the pilot papermaehine as described above. The results of sizing tests on the prepared board are listed in Table 5.

TABLE 5

Increasing the amount of polyvinylamine resin improves sizing performance.

| % PVAm based on dimer | % Dimer | HST 20% FA ink 80% Reflectance Seconds Mean | Std Dev | COBB TEST 2 min soak water g/sq m Mean | Std Dev |
|---|---|---|---|---|---|
| 0 | 0.100 | 8 | 1 | 236 | 4.95 |
| | 0.200 | 39 | 2 | 79 | 3.54 |
| | 0.300 | 133 | 3 | 41 | 0.71 |
| 5 | 0.050 | 10 | 1 | 158 | 39.60 |
| | 0.150 | 128 | 6 | 33 | 1.41 |
| | 0.250 | 831 | 10 | 32 | 1.41 |
| 10 | 0.050 | 7 | 0 | 240 | 2.12 |
| | 0.150 | 152 | 5 | 35 | 2.12 |

TABLE 5-continued

Increasing the amount of polyvinylamine resin improves sizing performance.

| % PVAm based on dimer | % Dimer | HST 20% FA ink 80% Reflectance Seconds Mean | Std Dev | COBB TEST 2 min soak water g/sq m Mean | Std Dev |
|---|---|---|---|---|---|
| | 0.250 | 966 | 45 | 27 | 0.00 |
| 19 | 0.050 | 7 | 0 | 220 | 2.83 |

TABLE 5-continued

| Increasing the amount of polyvinylamine resin improves sizing performance. | | | | | |
|---|---|---|---|---|---|
| % PVAm | | HST 20% FA ink 80% Reflectance Seconds | | COBB TEST 2 min soak water g/sq m | |
| based on dimer | % Dimer | Mean | Std Dev | Mean | Std Dev |
| | 0.150 | 172 | 4 | 34 | 1.41 |
| | 0.250 | 1608 | 147 | 31 | 2.83 |

As is demonstrated with these data, increasing the amount of polyvinylamine in the blend improves sizing performance, but significant increases are observed at fairly low levels of polymer.

Example 6

A sizing composition was prepared as described in Example 1 using Polyvinylamine 1 adjusted to pH 2.1. This sizing composition was evaluated on a commercial papermachine after aging for about 1 week. It was compared to Hereon 118 sizing agent, which is a promoted emulsion of alkyl ketene dimer (Hercules Incorporated, Wilmington Del.). Sizing was measured using the Cobb test. The results are presented in Table 6. The sizing composition of this invention was able to meet sizing targets at an addition level 24% lower than the incumbent product.

TABLE 6

| Commercial evaluations demonstrate improvements in efficiency. | | | | |
|---|---|---|---|---|
| Grade: 42# white top liner | AKD Addition Rate, % | 2 min Cobb, g/sq m average | 30 min Cobb, g/sq m average | Improvement % |
| Hercon 118 | 0.175 | 43 | 107 | |
| Example 6 | 0.133 | 46 | 113 | 24.1 |

This example shows that the quantity of size used for the inventive material is about 24% less than the commercial material while sustaining normal level for Cobb results.

The invention claimed is:

1. A stable paper sizing composition comprising:

a) a dispersion of a starch stabilized ketene dimer; and b) a clear homogeneous solution of a vinylamine-containing polymer having a pH below 3.0, and wherein the pH of the vinylamine-containing polymer is adjusted using an acid selected from the group consisting of hydrochloric acid, methylsulfonic acid, hydrobromic acid, nitric acid, formic acid and combinations thereof.

2. The composition of claim 1 wherein the pH of the vinylamine-containing polymer is between 2.1 to 2.5.

3. The composition of claim 1 wherein the pH of the vinylamine-containing polymer is adjusted with hydrochloric acid.

4. A paper sizing composition comprising:

a) a dispersion of ketene dimer; and b) a clear homogeneous solution of a vinylamine-containing polymer having a pH below 3.0, wherein the ketene dimer is stabilized with a starch having a Degree of Substitution (DS) less than 0.05, prior to combining with a vinylamine, wherein the pH of the vinylamine-containing polymer is adjusted using an acid selected from the group consisting of hydrochloric acid, methylsulfonic acid, hydrobromic acid, nitric acid, formic acid and combinations thereof, and wherein the loss of active ketene dimer is no more than 10% over 4 weeks storage at 32° C.

* * * * *